US011131455B2

(12) United States Patent
Stone et al.

(10) Patent No.: US 11,131,455 B2
(45) **Date of Patent: *Sep. 28, 2021**

(54) SYSTEM AND METHOD FOR BUILDING ORNAMENTAL FLAME DISPLAYS

(71) Applicant: Warming Trends, LLC, Englewood, CO (US)

(72) Inventors: Ray R. Stone, Littleton, CO (US); Divo Catozzo, Morrison, CO (US); Michael Windemuller, Morrison, CO (US)

(73) Assignee: Warming Trends, LLC, Englewood, CO (US)

( * ) Notice: Subject to any disclaimer, the term of this patent is extended or adjusted under 35 U.S.C. 154(b) by 70 days.

This patent is subject to a terminal disclaimer.

(21) Appl. No.: 16/741,944

(22) Filed: Jan. 14, 2020

(65) Prior Publication Data

US 2020/0149738 A1 May 14, 2020

Related U.S. Application Data

(63) Continuation of application No. 15/219,136, filed on Jul. 25, 2016, now Pat. No. 10,571,117.

(60) Provisional application No. 62/201,025, filed on Aug. 4, 2015.

(51) Int. Cl.
*F23C 5/02* (2006.01)
*F23C 5/08* (2006.01)

(52) U.S. Cl.
CPC . *F23C 5/02* (2013.01); *F23C 5/08* (2013.01)

(58) Field of Classification Search
CPC .... F23C 5/02; F23C 5/08; F23D 14/04; F23D 23/00; F23D 14/48
See application file for complete search history.

(56) References Cited

U.S. PATENT DOCUMENTS

| | | | |
|---|---|---|---|
| 804,496 | A | 11/1905 | Page |
| 1,539,420 | A | 5/1925 | Kerr |
| 1,590,195 | A | 6/1926 | Kerr |
| 1,791,509 | A | 2/1931 | Morrow |
| 1,818,783 | A | 8/1931 | Beam |
| 1,862,849 | A | 6/1932 | Frame |

(Continued)

FOREIGN PATENT DOCUMENTS

| | | | |
|---|---|---|---|
| CA | 2732462 | A1 | 7/2012 |
| DE | 10004159 | A1 | 8/2001 |

(Continued)

OTHER PUBLICATIONS https://web.archive.org/web/20111229122931/http://firepitoutfitter.com/productimages/warmingtrends/crossfire_close.gif, Dec. 2011 (Year: 2011).

(Continued)

*Primary Examiner* — Alfred Basichas
(74) *Attorney, Agent, or Firm* — Bejin Bieneman PLC

(57) ABSTRACT

A burner system includes a plurality of burners each including a nipple that is brass and a jet that is brass. The nipple in at least some of the burners has a first end that is open and a second end that is closed. The nipple has a side wall between the first end and the second end. The side wall defines a bore that extends through the first end to the second end. The first end, second end, and side wall of the nipple are of integral, one piece, construction free of joints. The nipple hole extending through the side wall and the jet is engaged with the hole.

18 Claims, 12 Drawing Sheets

(56) References Cited

U.S. PATENT DOCUMENTS

| | | | |
|---|---|---|---|
| 1,909,496 | A | 5/1933 | McKee |
| 1,956,857 | A | 5/1934 | Cunningham |
| 2,005,801 | A | 6/1935 | McKee |
| 2,188,116 | A | 1/1940 | Neale et al. |
| 2,547,276 | A | 4/1951 | Marsh et al. |
| 2,559,527 | A | 7/1951 | Williams |
| 2,569,514 | A | 10/1951 | Burklin |
| 2,647,303 | A | 8/1953 | Ziherl |
| 2,985,232 | A | 5/1961 | Greiner et al. |
| 3,038,064 | A | 6/1962 | Gieb |
| 3,270,967 | A | 9/1966 | Westerman et al. |
| 3,279,705 | A | 10/1966 | Stiefel |
| 3,291,190 | A | 12/1966 | Radley |
| 3,582,250 | A | 6/1971 | Chatfield |
| 3,614,281 | A | 10/1971 | Ramey |
| 3,760,790 | A | 9/1973 | Hodges et al. |
| 4,383,820 | A | 5/1983 | Camacho |
| 4,686,957 | A | 8/1987 | Koziol |
| 4,786,247 | A | 11/1988 | Bhattacharjee |
| 4,951,650 | A | 8/1990 | Boyes et al. |
| 5,000,162 | A | 3/1991 | Shimek et al. |
| 5,042,845 | A | 8/1991 | Laboe |
| 5,044,558 | A | 9/1991 | Young et al. |
| 5,081,981 | A | 1/1992 | Beal |
| 5,152,685 | A | 10/1992 | Coulon |
| 5,421,321 | A | 6/1995 | Ward |
| 5,474,102 | A | 12/1995 | Lopez |
| 5,556,550 | A | 9/1996 | Fyffe |
| 5,636,980 | A | 6/1997 | Young et al. |
| 5,868,128 | A | 2/1999 | Omar |
| 5,901,697 | A | 5/1999 | Oliver, Jr. et al. |
| 6,044,836 | A | 4/2000 | Olivier, Jr. et al. |
| 6,227,843 | B1 | 5/2001 | Pederson et al. |
| 6,269,809 | B1 | 8/2001 | Fleming |
| 6,289,887 | B1 | 9/2001 | Oliver, Jr. et al. |
| 6,901,773 | B2 | 6/2005 | Lawrence et al. |
| 6,945,774 | B2 | 9/2005 | Shoeb |
| 7,047,963 | B2 | 5/2006 | Van Vleet |
| 7,479,008 | B2 | 1/2009 | Thomas |
| 7,566,220 | B1 | 7/2009 | Thompson |
| 8,033,822 | B2 | 10/2011 | Junkins |
| 9,125,516 | B2 | 9/2015 | Adkins |
| 9,612,018 | B2 | 4/2017 | Bettinzoli |
| D793,806 | S | 8/2017 | Moy et al. |
| 9,816,705 | B2 | 11/2017 | Martin et al. |
| 10,571,117 | B1 * | 2/2020 | Stone ..... F23C 5/02 |
| 2003/0194671 | A1 | 10/2003 | Webb |
| 2004/0069149 | A1 | 4/2004 | Wakefield |
| 2005/0181321 | A1 | 8/2005 | Hart et al. |
| 2006/0088794 | A1 | 4/2006 | Purcell |
| 2007/0006528 | A1 | 1/2007 | Diebold et al. |
| 2007/0207429 | A1 | 9/2007 | Barker |
| 2007/0224560 | A1 | 9/2007 | Stainrod et al. |
| 2008/0115777 | A1 | 5/2008 | Hsu |
| 2008/0308645 | A1 | 12/2008 | Presley et al. |
| 2012/0074687 | A1 | 3/2012 | Mitchell |
| 2013/0071796 | A1 | 3/2013 | Cole |
| 2014/0008455 | A1 | 1/2014 | Muff et al. |
| 2015/0354814 | A1 | 12/2015 | Cody |
| 2016/0053580 | A1 | 2/2016 | Briggs |

FOREIGN PATENT DOCUMENTS

| | | | |
|---|---|---|---|
| GB | 190923368 | A | 9/1910 |
| GB | 1126776 | A | 9/1968 |
| KR | 20100024828 | A | 3/2010 |
| WO | 2002093076 | A1 | 11/2002 |

OTHER PUBLICATIONS https://web.archive.org/web/20131130022654/thhp://www.warmng-trends.com/crossfireburners.html, Nov. 2013 (Year: 2013).

"Chapter 3: Pipe Fittings," Pipe Drafting and Desing, by Roy A. Parisher and Robert A. Rhea, 3rd ed., Elsevier/GPP, 2012, pp. 36-37. (Year: 2012).

Fulford, Dr. David; Blogas Stove Design a Short Course; Aug. 1996; used in MSc Course on "Renewable Energy and the Environment" at the University of Reading, UK for and Advanced Biomass Module.

http://fireflypatio.com/fire-pit-kits.html; Firefly Patio & Hearth; Jan. 26, 2018.

2013 Warming Trends Catalog; published Oct. 3, 2013; pp. 1-42.

2014 Warming Trends Catalogue; published May 1, 2014; pp. 1-39.

YouTube video screen capture: "Hottest Firepits in The Market," published Mar. 1, 2012.

YouTube video screen capture: "Hottest Firepits in The Market," published Feb. 8, 2012.

* cited by examiner

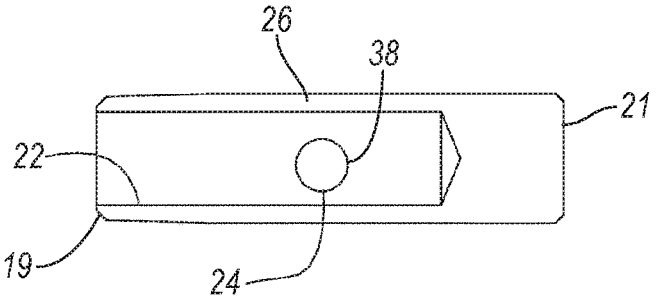
FIG. 5C
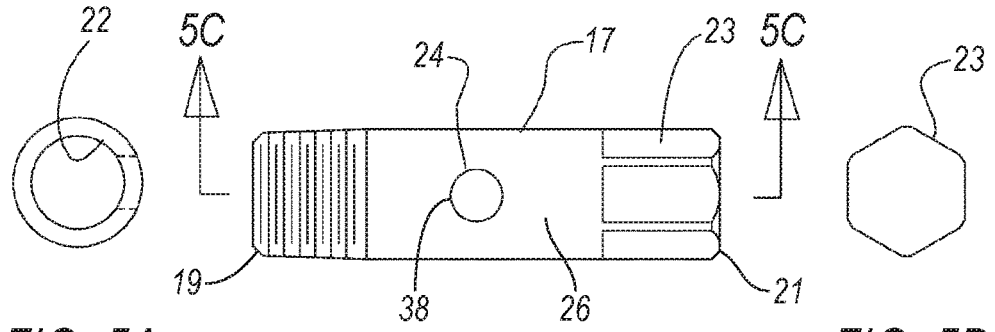
FIG. 5A
FIG. 5
FIG. 5B

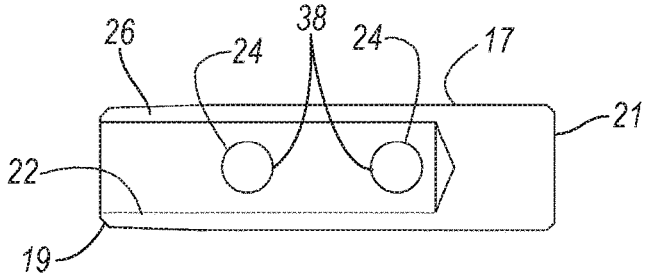
FIG. 7C
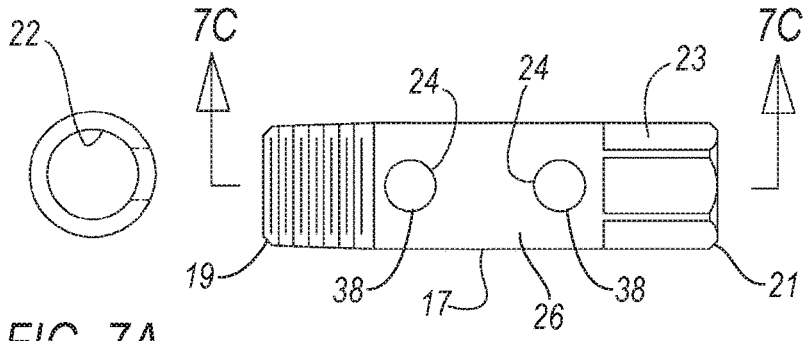
FIG. 7A
FIG. 7B
FIG. 7

SYSTEM AND METHOD FOR BUILDING ORNAMENTAL FLAME DISPLAYS

CROSS-REFERENCE TO RELATED APPLICATIONS

This application claims priority to and is a continuation of U.S. patent application Ser. No. 15/219,136, filed on Jul. 25, 2016, now issued as U.S. Pat. No. 10,571,117, which application claims priority to U.S. Provisional Application No. 62/201,025, filed on Aug. 4, 2015, which applications are hereby incorporated herein by reference in their entireties.

FIELD OF THE INVENTION

This application relates to a system and method for creating ornamental fire displays. More specifically, but not by way of limitation, to a system that uses sets of brass pipe sections and connectors that allow the sections to be joined and provide support for jets that use the "Venturi effect" to mix gas and air to produce a low-heat flame of a desired color. The connectors thus allow positioning of the jets to create a bright, wide, ornamental flame with a natural appearance of a wood fire. Natural wood fire is characterized by its orange, yellowish-orange color, and movement or "dancing" appearance.

BACKGROUND

The use of fire and torches that produce flames for the purpose of providing illumination is well known. Additionally, the calming and comfort that that people innately draw from watching a campfire or other moderately warm flame is widely understood and appreciated by people of all cultures. In order to take advantage of these aspects of fire, many manufacturers have offered fire pits that burn natural and/or LP gas. An example of such devices can be found in U.S. Pat. No. 6,289,887 to Oliver, Jr. et. al., incorporated herein by reference. Another such device is disclosed in U.S. Patent Application Publication No. 20070224560 to Stainrod et al. However, a problem associated with flames produced by known devices is that the flames are often blue, or they appear rushed due to the fact that they are burning a gas that is ejected from a jet. The ejected flame has little opportunity to behave like a flame from a log, and thus does not provide the ambiance created by a wood fire. Still further, fast flowing gas flames can produce inordinate amounts of heat, forcing the user to compromise and settle for a small flame in exchange for comfort and safety.

Additionally, a significant limitation of known devices that are used for burning natural gas, such as in a fireplace or in a fire pit, is that these systems are not readily customizable. Specifically, the systems have to fit within standard size fireplaces or fire pits. Thus, architects and other designers have to compromise as to the shape or size of the fireplace or pit, which may not always optimal for the architectural or aesthetic needs of the room or structure that will house the flames.

Still further, known devices typically use a single manifold, which is often a hollow ring, as shown in U.S. Pat. No. 1,539,420 to Kerr, incorporated herein by reference. The Kerr asserts that an object of his device "is to group the jets in a particular way to gain the maximum heating effects within a given area without causing a malfunction in mixing and burning." Thus, Kerr uses the hollow ring in combination with nozzles that are positioned closely to one another in order to create an area of intense heat for heating water, for example. Thus, the ring manifold of Kerr includes perforations and nozzles that release gas to be burned in a concentrated area, such as immediately below a kettle or water tank.

Moreover, the Kerr's nozzles are mounted from bosses that point the air and fuel mixture ejected from the nozzles in directions that result in a collision of the streams of air and fuel mixture ejected from the nozzles to collide with one another, and thereby create "sheets" of flames that burn blue in color.

A known fire pit system, shown in U.S. Pat. No. 9,125,516, incorporated herein by reference, uses a manifold that has a multitude of holes. The manifold is filled with gas, and then the gas is allowed to escape through the holes of the manifold. The released gas is then burned as it encounters air outside of the manifold. This approach is very inefficient in terms of the creation of voluminous flames that are visible and in terms of heat radiated from the flames. The absence of nozzles results in little control over the flow of the gas, and thus results in inefficient burning and results in small, low-volume, flames with little movement.

Another limitation of known devices is that typically they cannot be easily customized to nest into fire pits or support areas of different sizes. Still further, many gas fire pit designs use a single pad, ring-shaped, or close-looped manifold that provide a centralized flame area. This approach is inherently inefficient because it creates either a focused region of flames and a focused high-temperature region, or a large area with small flames. The large area of small flames is a product of the fact that a manifold with numerous apertures will result in rapid pressure loss along the manifold, which in turn results in small flames. The use of large number of small flames results in low brightness and a generally dull fire pit.

The use of pre-fabricated, single manifold designs has yet additional limitations. One important limitation is that they are not particularly well suited for accommodating pits of different shapes. Thus, they do not allow an architect or designer the flexibility in routing of the burner system, so as to accommodate variations in fire pit designs nor are they well suited for reliable, repeatable, installation in the field. While it is possible to link several pre-fabricated manifolds together, the use of these systems for providing decorative flame arrangements presents important problems and creates a need for a system that produces reliable connections in a repeatable manner. A decorative flame system must lend itself to predictable, repeatable assembly of arrangements, without the need for highly trained technicians.

Prior systems relied heavily on commercially available galvanized gas pipe and mating end caps. In these systems the gas pipe required the cutting of sections of pipe, and the addition of threads that accept the end caps. The pipe along with jets would then be assembled though the use of common plumbing tools, such as pipe wrenches. However, this approach resulted in problems associated with marring of the surfaces of the assembly. The scars left by the tools needed to assemble the galvanized pipe systems inherently produced arrangements that with the unfinished appearance of uncovered plumbing.

Moreover, creating reliable connections and seals at the joints of the sections of pipe were concern. Installers had to rely on experience as to the adequate torque levels for the galvanized pipe connections. Additionally, the use of galvanized pipe end caps, particularly those made of galvanized steel, resulted in assemblies that were unreliable in terms of torque and resulting gas-tightness, and were aesthetically unpleasant. Specifically, the use of galvanized pipe and end caps created problems in verifying that proper amounts of torque had been applied to the sections of pipe so as to ensure a gas-tight seal. Thus it has been discovered that the use of galvanized steel tubing for creating the support sections for nozzles or jets that are used to create ornamental fire pits and displays has several significant disadvantages.

It has been discovered that the use of jets, which draw air and mix the air with gas flowing through the system, provide significant advantages over simply using plenums with apertures that allow gas to escape and burn. However, there also remains a need for an attachment of the jets to a gas distribution system that provides support for the jets, while at the same time providing an aesthetically pleasing, hermetic, routing for the flammable gas used to create the ornamental flames. One approach for providing jet support would be to weld or solder a boss to the components of the gas distribution system to support the jets. This is the approach used shown in U.S. Pat. No. 1,539,420 to Kerr, discussed above, which uses fixed bosses that support jets with relatively large side apertures to create a tight, circular pattern, of high-temperature flames. However, this approach would greatly increase the cost of the components by increasing the amount of material used to create the system, and increasing the amount of machining needed to create the bosses. Additionally, a distribution system with integral, one piece, bosses lack the necessary adaptability to allow the assembly of fire pits of various sizes and shapes. Thus systems that have plenums with bosses at pre-established, fixed, locations allow creation of arrangements that use only the fixed locations of the bosses for the mounting of jets.

Therefore, a review of known devices reveals that there remains a need for an efficient system for creating flames for use in a decorative fire pit and produce controlled ornamental flame features for architectural design use, or for use as an independent ornamental flame display.

There remains a need for a system with components that allow the user to form a variety of flame patterns in a predictable and reliable manner.

There remains a need for a system that allows the creation of a variety of flame patterns, without requiring different castings with different boss locations.

There remains a need for a system that creates tall, orange-tone gas flames of relatively low temperature, as compared with blue gas flames commonly used for cooking or soldering.

There remains a need for a system that can be used with known, widely available, gasified fuel delivery systems, and that allow the creation of a large flame area or large flame volume, with a relatively small amount of gas.

Still further, there remains a need for a system that allows the user to spread out the flame jet locations, and use the positions of the flame jets to create a voluminous flame pattern, which results in more efficient distribution of light produced by the individual jets.

There remains a need for a system that allows the user to spread out the flame jet locations, and use the jet positioning to create a voluminous flame pattern with correspondingly distributed heat or flame sources, which will result in efficient distribution of heat and light produced by the individual jets used with the system. There remains a need for a system that allows the creation of ornamental flames along a line immediately above a pool of water.

SUMMARY

It has been discovered that the problems left unanswered by known art can be solved by providing a system that uses jet support sections and jet support connections to allow the user to create a gas delivery pattern that results in broad swirling of the gas being delivered, and in turn in thorough combustion of the gas delivered, which in turn results in wide dispersion of heat and light produced with the flames. The wide dispersion of the flames in turn results in reduced heat concentration, while at the same time resulting in broad dispersion of light. Additionally, the disclosed system allows arrangement of the jets in a manner that creates flow of a combustible mixture of air and liquefied petroleum ("LP") gas or natural gas. The mixture being of a ration that does not create a flame that burns at dangerous or unmanageable temperatures, while at the same time creating a fuller wider natural dancing ornamental flame than achieved with devices in the prior art.

Still further, it has been discovered that the disclosed system allows the creation of ornamental pools with ornamental flames rising from just above the water. This not only provides the display of the flames created with the system, but also allows the flames to be reflected from the water, creating a particularly pleasing ornamental flame display.

According to an example disclosed here, the system uses jet support sections are formed from straight sections brass pipe, commonly referred to as nipples. The nipples will extend along a nipple axis and may include at least one aperture for accepting or creating a gas jet or jet that will deliver a stream of gas along a jet axis. The jet will be positioned along the nipple. The pipe nipple is preferably threaded to allow the user to point the jet at a desired angle to the plane of the section of pipe supporting the jet. In other words, if the nipple axis extends a generally horizontal plane, then a plane defined by the jet axis and the nipple axis will be at an angle to the horizontal plane. In some of the disclosed assemblies the nipple axis is often at 45 degrees to the axis of the jet, or the axis of the jet may be vertical. Accordingly, the angle of the jet relative to the nipple or conduit supporting the nipple may be varied in order to achieve different flame effects, such as swirling of the flames, or to create an arrangement where the flames fill a large volume without releasing large amounts of heat. For example, a large fireplace for a hotel lobby may be built and the hearth filled with flames formed using the disclosed inventive principles. The flames could be used to surround synthetic logs, and would provide the desired volume of a large fire without the danger and heat discomfort created by a wood fire of similar size. In other words, the disclosed system is particularly efficient in creating voluminous flames. Accordingly, flames created with the disclosed system may also be incorporated in back-yard fire pits or ornamental pools, and thus provide the attractiveness of a flame, while greatly reducing the danger of a similarly-sized fire created with wood, for example.

The support connections of disclosed examples might themselves include at least one aperture for accepting or feeding a gas jet or jet to deliver a stream of gas along a jet axis.

Thus, the disclosed system may be assembled to create a straight-line pattern, with a pair of long nipples extending from I-shaped support connector with a vertical inlet, each long nipple having multiple jets extending from each nipple. An "H" pattern could also with a I-shaped support connector with a vertical inlet and a pair of opposing nipples extending from the vertical inlet. Each of the opposing nipples may in turn support another I-shaped support connector, each of the I-shaped support connectors supported from the nipples having an inlet and a second pair of opposing nipples. The second pairs of opposing nipples would have an aperture for accepting or creating a gas jet or jet. The opposing nipples would be a pair of blind opposing nipples, and thus forcing any gas entering into the assembly to exit through the gas jets.

The I-shaped support connector with a vertical inlet may also have an aperture for accepting or creating a vertical gas jet or jet that is coaxially positioned with the vertical inlet. It is preferred that the second pairs of opposing nipples of this example would have jets that are pointed up, so that the jets deliver converging gas streams. This arrangement will allow the converging gas streams to create a swirling pattern of gas and air above the H-shaped arrangement. The swirling pattern of gas will be driven up by gas flowing from the vertical gas jet. It will be understood that the resulting flame will also have an upwardly swirling pattern, and thus will be far more visible and bright than flame patterns created with previously known systems.

Aboveground gas lines may be made of steel or ductile iron, copper, yellow brass, or aluminum pipe. Steel or ductile iron requires the use of PTFE (such as Teflon®) or other sealants in order to ensure a hermetic seal. These sealants are not designed for use next to flames, and thus steel or iron pipe is not particularly suitable for use as part of a gas flame manifold. Moreover, the appearance of steel or ductile iron piping is not aesthetically pleasing to many. Aluminum and copper are soft, malleable, metals that can produce gas-tight seals, but their use is disfavored due to the possibility of corrosion and pitting. This leaves brass as a desirable material for creating manifold for an ornamental gas flame manifold. However, while brass provides desirable sealing without scarring or marring, corrosion resistance, and aesthetic characteristics, it presents problems due to its malleability. The softness of brass often leads to unsightly scoring of the surfaces of the sections being joined.

Typically, nipples for gas pipes are connected to one another using pipe wrenches. Pipe wrenches are used because sections of pipe are typically cut to length as needed in the field, and then threaded in the field. The cut sections of pipe do not have landings to allow screwing the sections of pipe together, and thus pipe wrenches are commonly used to join sections of threaded pipe. The grip provided by the teeth of pipe wrenches against the surface of the pipe is needed to ensure a hermetic connection. However, the engagement of the teeth inherently results marring and gouging, or scarring, of the surfaces of the pipe almost inevitably occurs. This is especially true when the wrenches are used to provide sufficient torque to the brass sections being joined so as to create gastight seals between the components. Accordingly, disclosed embodiments use brass support sections such as pipe wrenches, to create an appropriate seal results in an unsatisfactory appearance on the ornamental gas flame manifold.

It has been discovered that problems associated with consistently creating sealed connections between sections of the system are greatly reduced, if not eliminated, by using nipples with integral features that allow turning of the nipples while connecting the threaded sections, without marring or scratching of the surfaces of the nipples. These features allow the assembly and installation of the disclosed systems in a reliable, repeatable manner without marring the surfaces of the nipples. Additionally, the use of a torque wrench provides the benefit of a reliable connection, without the marring of the surfaces of the nipples through the use of pipe wrenches.

Accordingly, it will be understood that the disclosed system provides at least the following benefits over the prior art:

The integration of the end caps and the nipples that support the jets results in fewer leak points;

The use of the jets that use the Venturi effect to accelerate the flow of gas and mix the gas with air results in a taller and brighter flame;

The use of jets with metering side apertures for creating an appropriate fuel-air mixture that is accelerated as the gas flows through the jet results in a more fuel-efficient system.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which:

FIG. 5 illustrates an example of a nipple with a "blind," closed end and potential aperture locations for accepting jets or "jets" disclosed here.

FIG. 5A is an end view of the open end of to the blind nipple shown in FIG. 5.

FIG. 5B is an end view of the blind end portion of to the blind nipple shown in FIG. 5, the view also illustrating the integral hex surfaces that may be engaged with a suitable tool, such as a wrench.

FIG. 5C is a sectional view taken along the arrows marked "5C" in FIG. 5.

FIG. 7 is a perspective view of another example of a nipple used with the disclosed system.

FIG. 7A is an end view looking towards the threaded end of the example shown in FIG. 7.

FIG. 7B is an end view looking towards the hexed end of the example shown in FIG. 7.

FIG. 7C is a sectional view taken along the arrows marked "7C" in FIG. 7.

Figure 12:
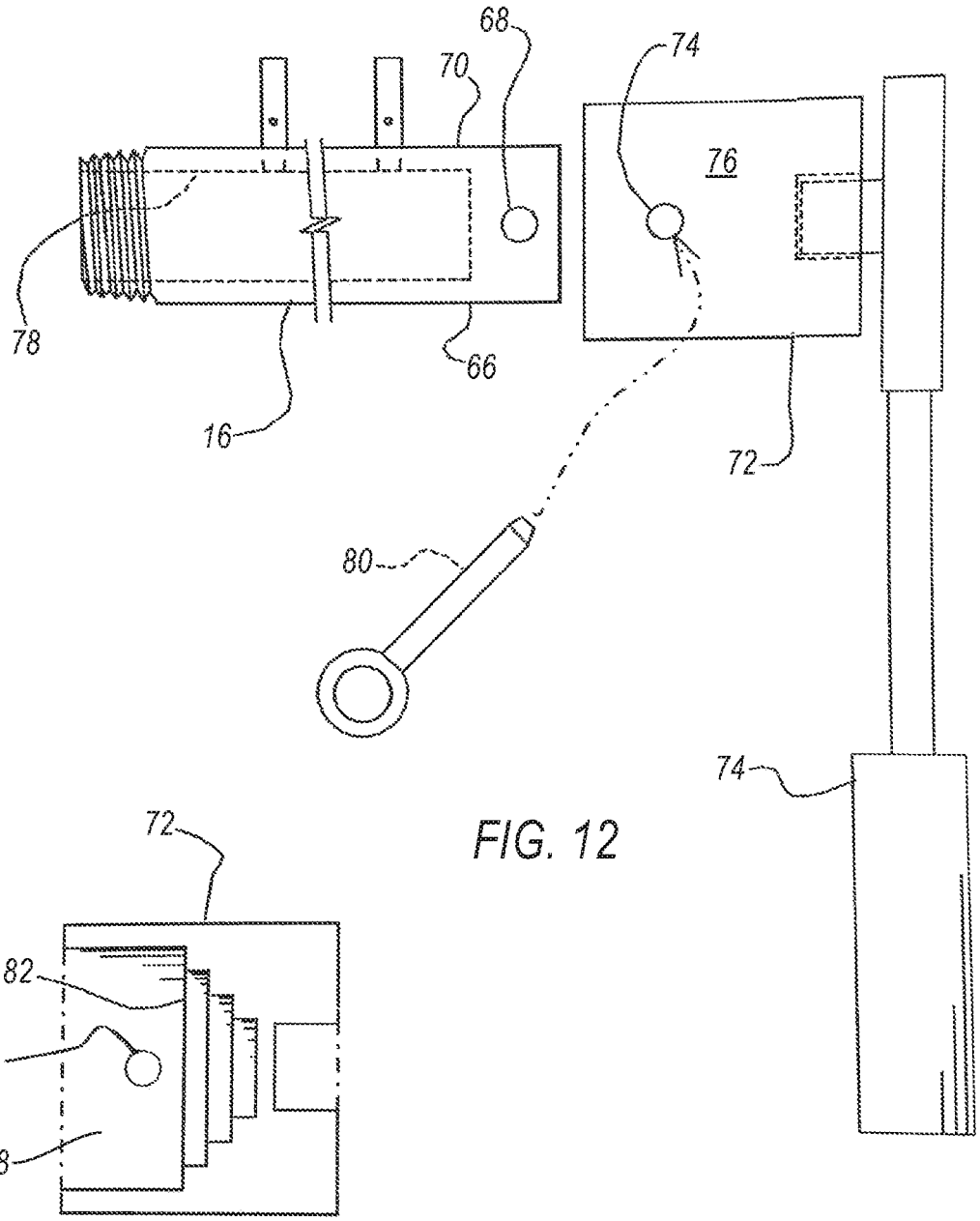
FIG. 12 illustrates an example of a tool that facilitates engaging and turning the nipples of the disclosed system during assembly and installation.
Figure 13:
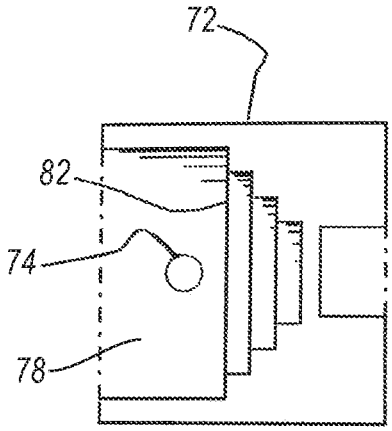

FIG. 13 shows a cross section of a socket that may be used in the manner illustrated in FIG. 12. The example of the socket shows stepped internal sections of progressively smaller diameters. However, it is also contemplated that the internal surface may be of a single, continuous shape or cross section.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
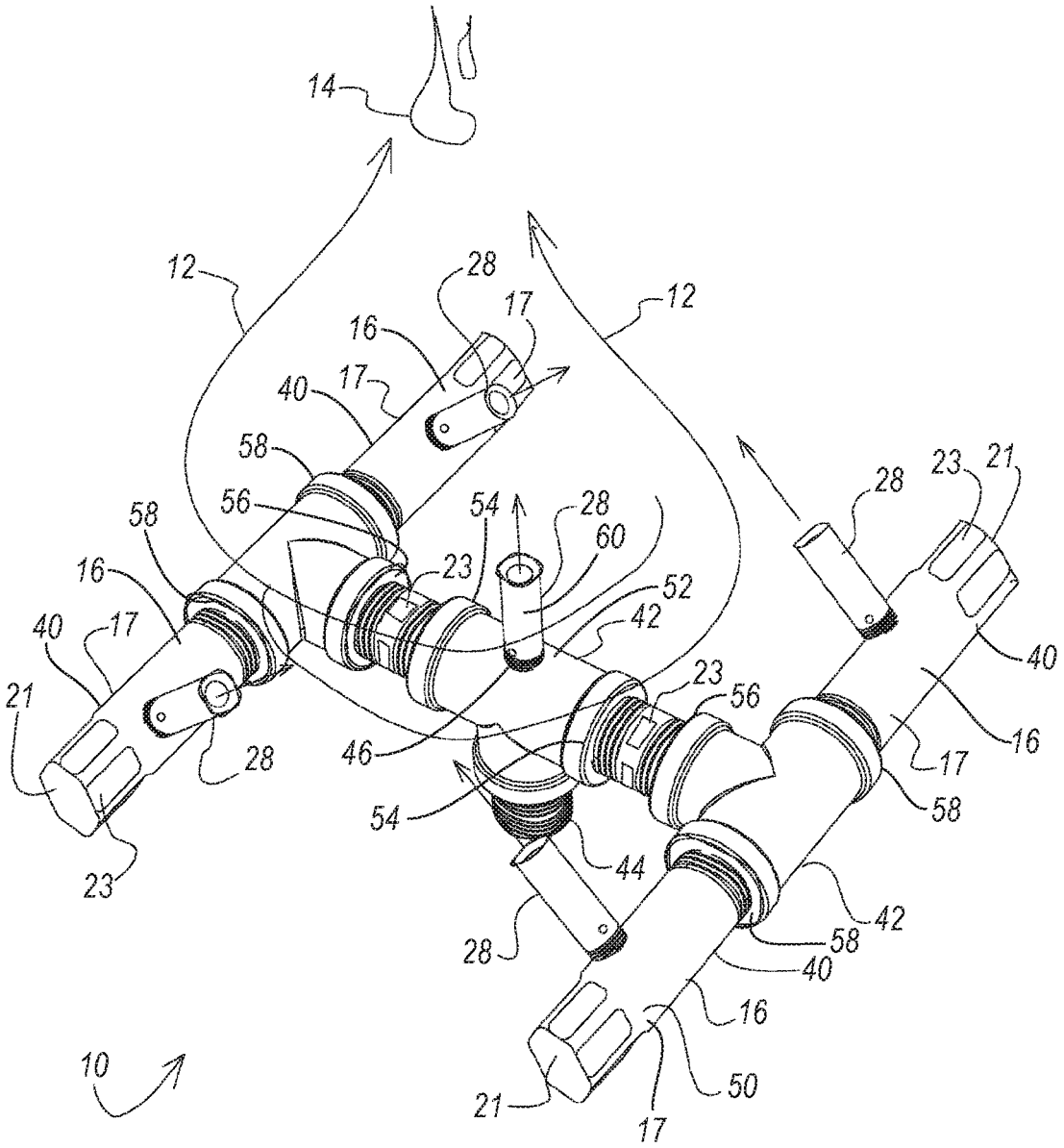
FIG. 1 is a perspective view of an assembly used for creating ornamental flames, the assembly using components and principles of disclosed here. The view also illustrates that the locations of the apertures for supporting jets along the nipples may be varied, and that nipples without jets may be used where the nipple is being used merely as a spacer or conduit.

Turning now to FIG. 1, where an example of the disclosed system 10 for creating an ornamental flame. The system 10 being particularly well suited for creating a swirling flow of gas 12 to create a controlled flame 14. It will be understood from the accompanying drawings that the system 10 uses jets 28 that are mounted from jet support sections 40 (also referred to as nipples 16). A preferred example of the system 10 is made primarily of brass sections, which allows the system 10 to be exposed to the elements and resist corrosion.

FIG. 1, illustrates that the disclosed system 10 uses the jet support sections 40 and jet support connectors 38 to allow the user to create a gas and air mixture delivery pattern that produces swirling of the gas mixture being delivered. Ignition of the gas mixture results in a flame that produces a wide dispersion of heat and light. The wide dispersion of the heat results in lower flame temperatures, which makes the disclosed system particularly well suited for creating ornamental flames.

The accompanying figures, including FIGS. 1 and 5, show that the system 10 uses pipe nipples 16 of different lengths as building blocks for the system 10. The pipe nipples 16 may have gas-flow passages 22 that extend through the entire nipple 16, or they may be blind nipples 17 that include a first end 19 that is threaded and a second end 21 that is closed off, and thus "blind." The term "blind" is commonly used in mechanical arts to refer to a hole or bore that does not extend through the base material, and thus it is not possible to see through the hole. An example of a blind nipple 17 is shown on FIG. 5. It is preferred that the nipples 16 be of integral, one-piece, construction. The one-piece, integral, construction not only eliminates joints that may leak from improper assembly or from weathering, but as discussed below also aids in ensuring that the entire assembly is tightened to a proper torque level.

The nipples 16 used with the disclosed system incorporate landings 23 that allow engagement of the nipple 16 with a wrench. This allows the use of a single threaded connection to the nipple 16 and any connectors that cooperate with the nipple 16. Since hexagonal sockets are commonly used with torque wrenches, illustrated examples show the use of landings 23 that create a generally hexagonal shape. However, it should be noted that any suitable shape for engagement with a wrench or suitable tool may be used, for example a square, star, or slotted shapes may also be integrated on the blind end.

Having a single threaded connection associated with a particular nipple 16 allows the technician assembling the system 10 to achieving the proper torque level for the connection. Known systems that use galvanized pipe, for example, require the threading and tightening the pipe against a supporting connection, and then a separate cap to the pipe in order to create a branch for the system. These two connections in series make it difficult for the installer to verify that both joints have reached proper torque, or tightness.

Thus, preferred examples of the pipe nipples 16 used with the disclosed system 10 include a passage 22 that extends from the first end 18 towards the second end 20, and where required, a bore 24 is made through the sidewalls 26 of the nipples 16 are drilled and tapped so as to accept a jet 28. As discussed above, the jets 28 serve to create a suitable air/fuel mixture and mixture flow velocity for creating the desired size and "dancing" aspects of the flames.

Figure 9:
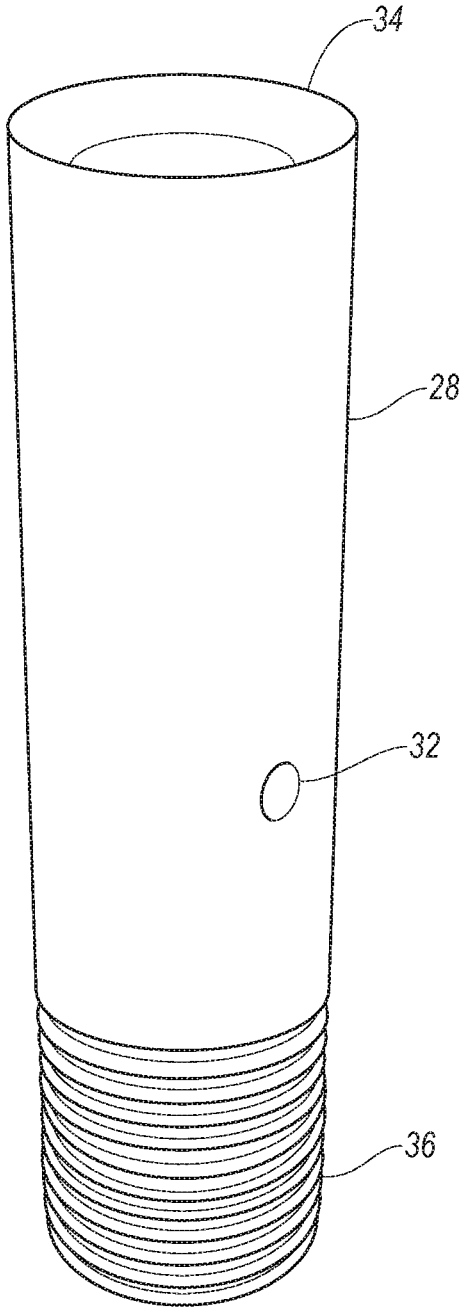
FIG. 9 is a perspective view of a jet.
Figure 10:
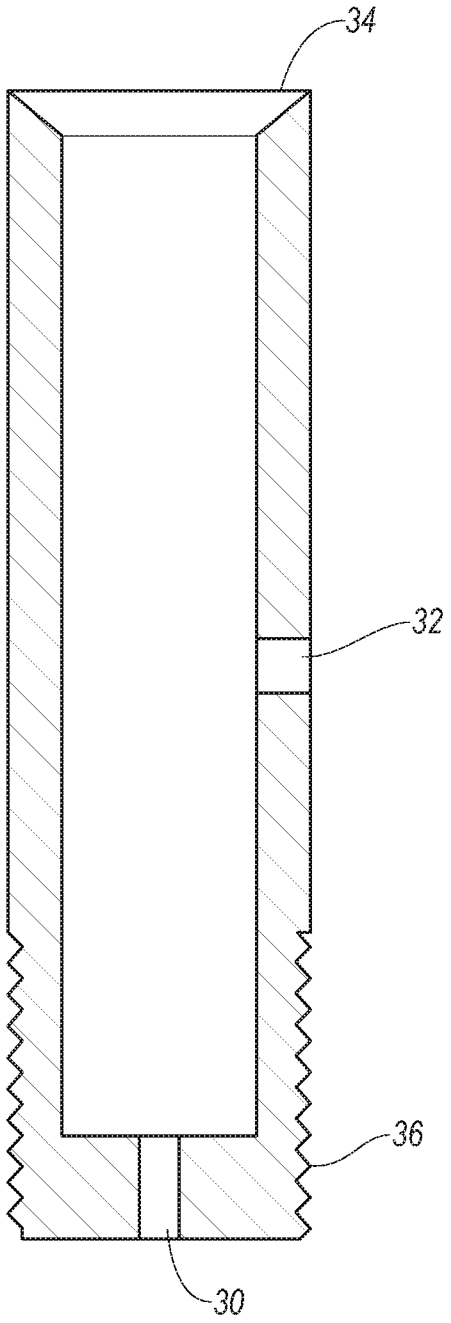
FIG. 10 is a cross-sectional view of the jet of FIG. 9.

As illustrated in FIGS. 9 and 10, a preferred example of the jets 28 includes a restricted inlet 30, a side opening 32 and a chamfered exit 34. The restricted inlet 30 has external threads 36 that are adapted for engaging mating threads in the bore 24, which allows the bore 24 to serve as a jet support connector 38 (identified in FIGS. 4-5C). Thus, attaching one of the jets 28 to the bore 24 will allow pressurized gas within the nipple 16 to flow and expand through the jet 28. This, in turn, will allow the jet 28 to mix the flow of flammable gas with air drawn through the side opening 32 by means of the well-known Venturi effect. Thus, a nipple 16 will function as a jet support section 40, when bored and fitted with at least one jet 28.

The use of the disclosed jets 28 provides important results over the prior art, which typically simply provided apertures along a manifold, and did not use the Venturi effect as carried out by the disclosed system 10. The jets 28 disclosed here use the Venturi effect to mix gas and air at a ratio that will produce flames of a desired color, temperature, and flame size. The precise size and location of the side openings 32 are controlled by the size of the jet 28 and the flame effect desired from that particular jet 28. Thus, the use of multiple jets 28 in an assembly will allow the manufacturer or installer to customize the overall flame display through the arrangement of different jets 28 along a nipple 16. Typically, the variation is accomplished by varying the location and/or size of the side opening 32 so as to vary the fuel-air mixture by a specific jet 28. Accordingly, it will be understood that the disclosed system provides the installer or manufacturer with the ability to vary the appearance of the overall flame arrangement to achieve configurations that were not achievable with the prior art.

Turning once again to FIG. 1, it will also be understood that the disclosed system will also use I-shaped support connectors 42. One of the I-shaped support connectors, the central I-shaped support connector 52, will include a vertical inlet 44 and preferably also have a top aperture 46 for accepting or creating a vertical gas jet 28 that is coaxially positioned with the vertical inlet 44.

It is further contemplated that the entire system 10 disclosed here will preferably be made from brass, although stainless steel is also suitable as both of these metals can resist the elements encountered by outdoor fire pits. However, brass is a preferred material due to its ease of machining and the aesthetically pleasing finish achieved in the end product.

The central I-shaped support connector 52 will have a pair of generally horizontal outlets 54. The horizontal outlets 54 being adapted for accepting the jet support connectors 38. Like the central I-shaped support connector 52, other I-shaped support connectors 42 used with the system 10 will include an inlet 56 and a pair of outlets 58. Thus, nipples 16 will extend from the outlets 54 of the central I-shaped support connector 52.

Figure 2:
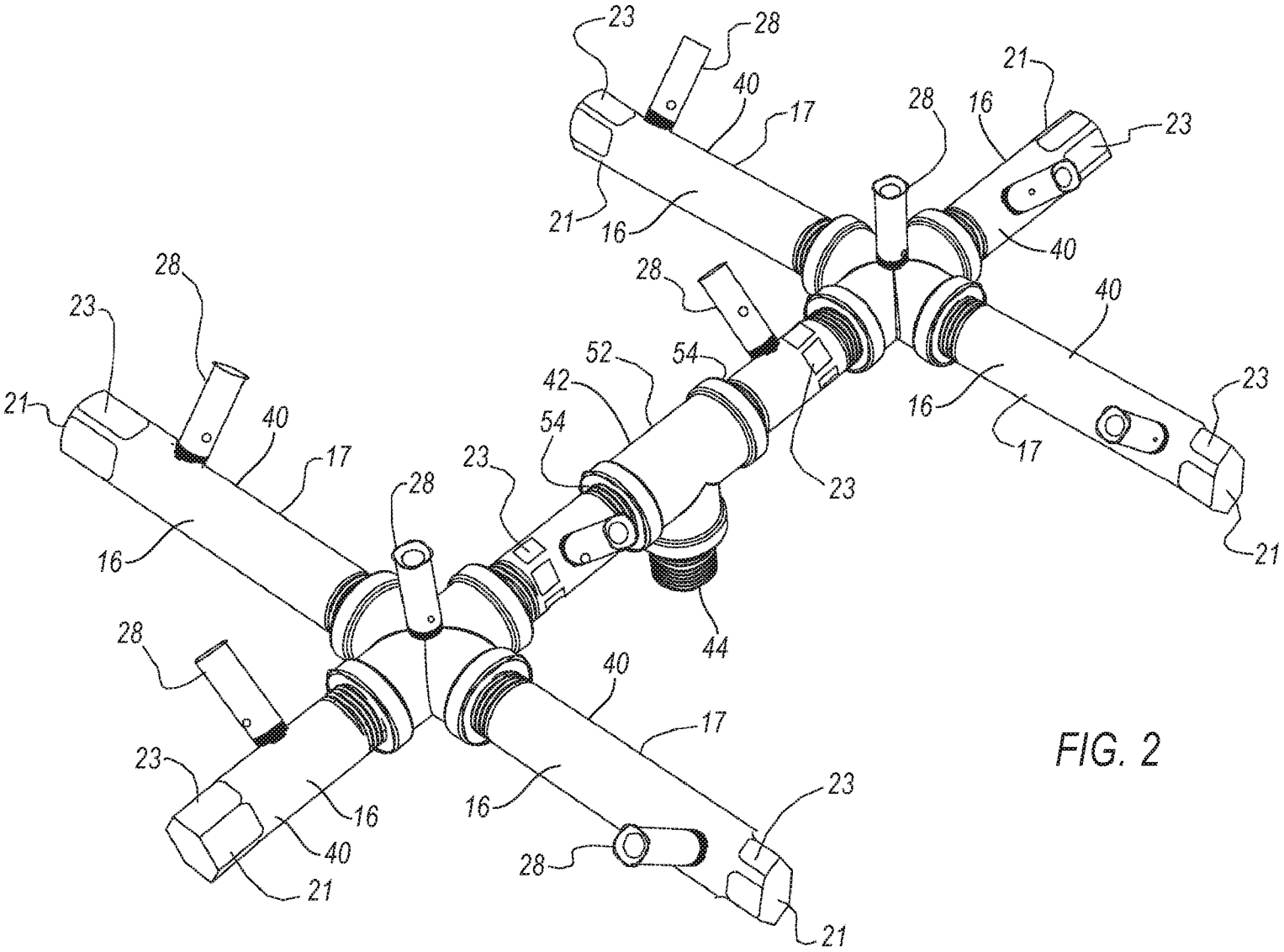
FIG. 2 is a perspective view of another arrangement for creating ornamental flames.

FIGS. 1 and 2 also show that it is preferred that the gas jets 28 mounted from parallel jet support sections 40 will preferably mounted at an acute angle to the jets 28 that extend from the parallel jet support sections 40. This acute angle will result in the air and gas mixtures delivered from these opposing jets 28 will be in generally converging paths, leading to swirling of the air and gas mixtures. Additionally, the flow delivered from the vertical jet 60 mounted from the central I-shaped support connector 52 will flow up, intersecting the flows from the parallel jet support sections 40. This convergence of flows has been found to produce surprisingly bright and efficient burning of the gas. Additionally, since the gas flows, and therefore the flames, are well separated from one another, the dispersion of the heat created by the flames prevents focused, intense heat, and thus results in a safer arrangement than those of the prior art.

Figure 3:
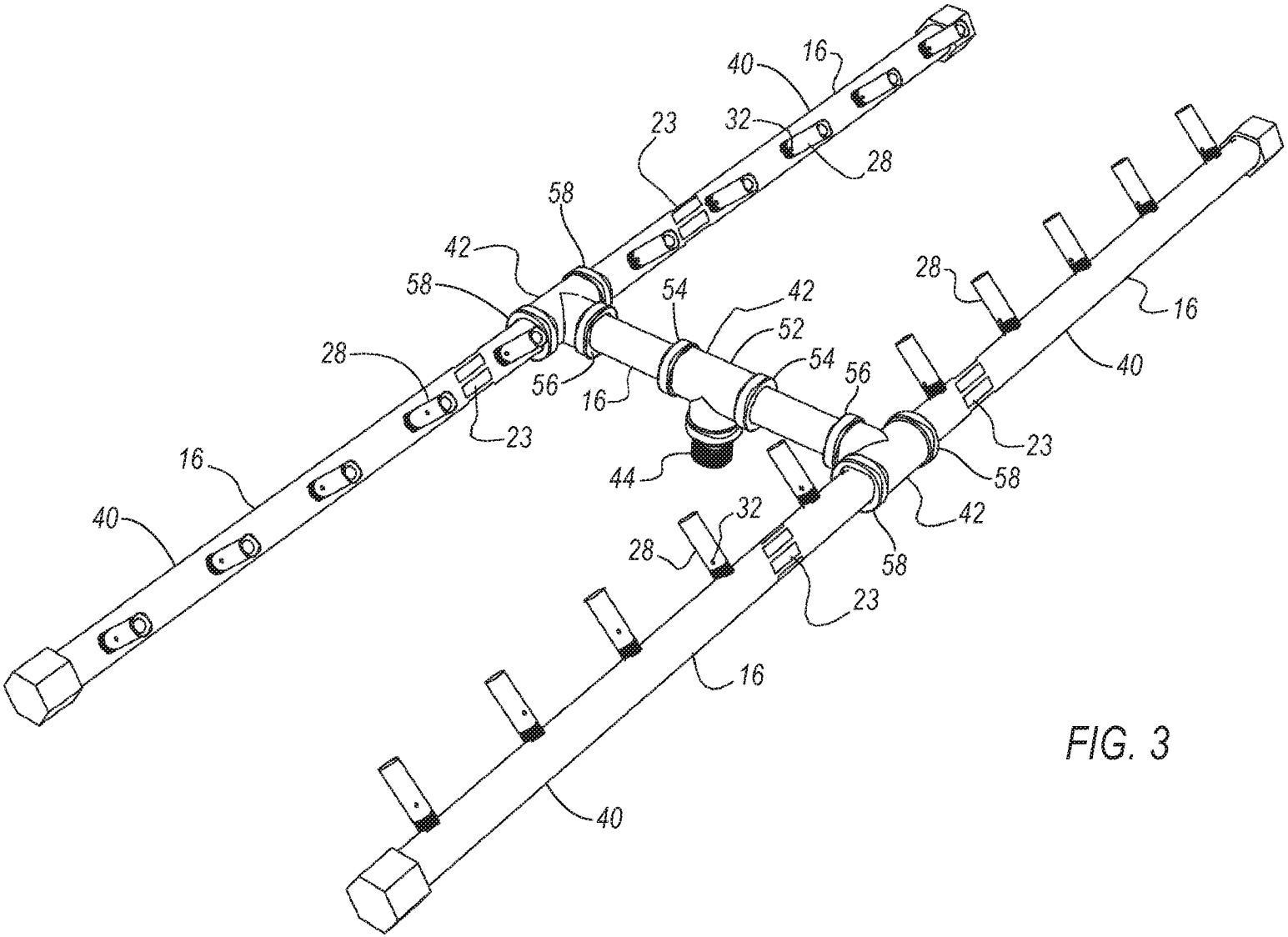
FIG. 3 illustrates the use of the disclosed system to create a larger arrangement than the arrangement shown in FIG. 1.
Figure 4:
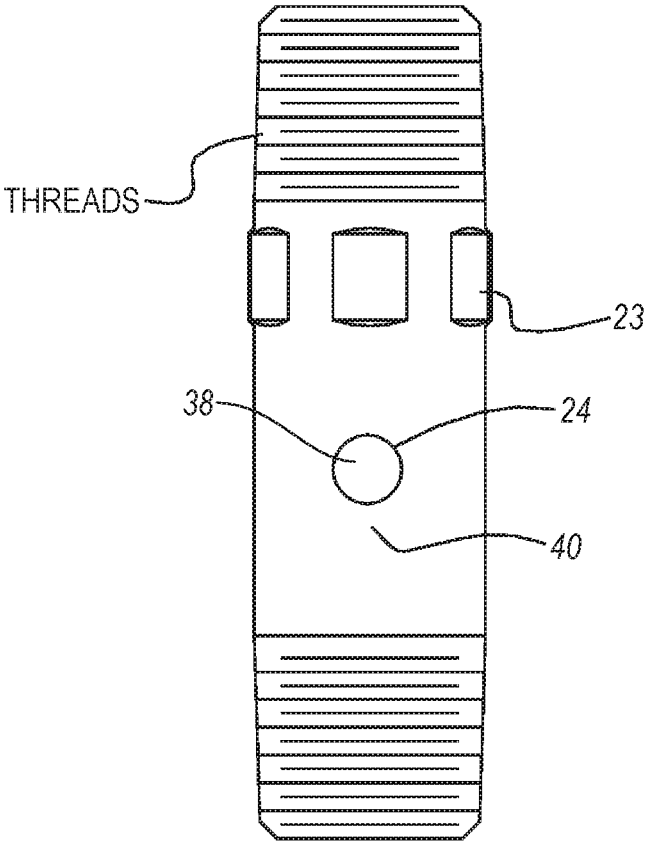
FIG. 4 is a side view of a nipple used with the disclosed system.
Figure 6B:
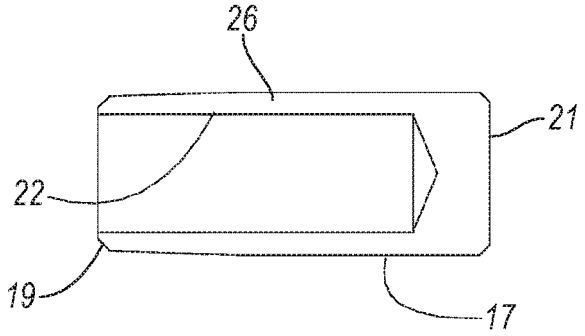
FIG. 6B is a sectional view taken along the arrows marked "6C" in FIG. 6.
Figure 6:
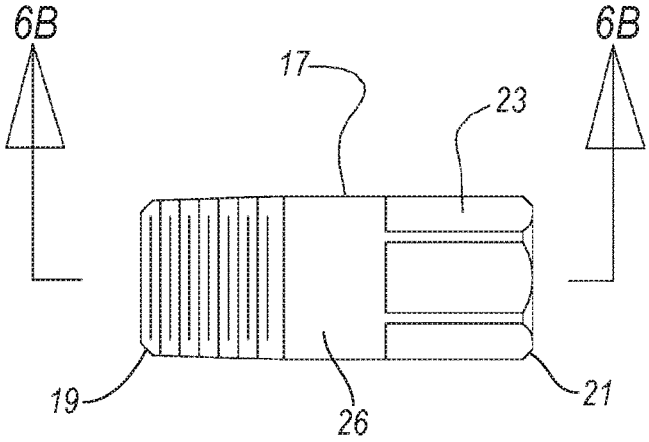
FIG. 6 illustrates an example of a nipple with a "blind," closed end.
Figure 6A:
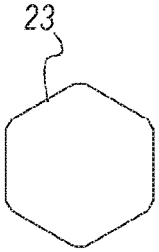
FIG. 6A is an end view of the blind end portion of to the blind nipple shown in FIG. 6, the view also illustrating the integral hex surfaces that may be engaged with a torque wrench.
Figure 8B:
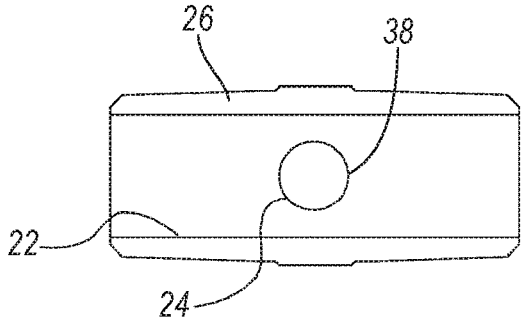
FIG. 8B is a sectional view taken along the arrows marked "8B" in FIG. 8A.
Figure 8:
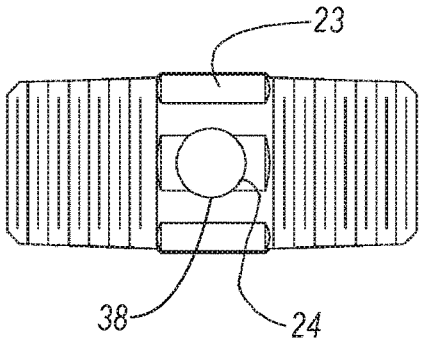
FIG. 8 is a perspective view of another example of a nipple used with the disclosed system.
Figure 8A:
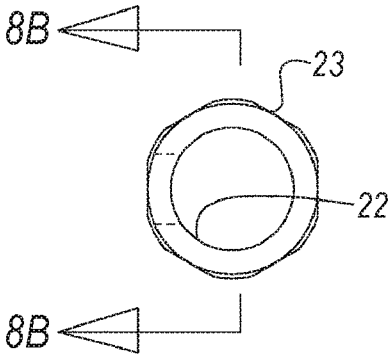
FIG. 8A is an end view looking towards one of the threaded ends of the example shown in FIG. 8.

Turing now to FIGS. 3 and 4, it will be understood that the principles used to make the example shown in FIGS. 1 and 2 can be used to create an expanded system. The expanded system connecting a pair of H-shaped arrangements, the arrangements being supported from a central I-shaped support connector 52, which also uses vertical gas jet 28. Also, the larger system of FIG. 3 uses a pair of jet support sections 40 which extend from the central I-shaped support connector 52.

The disclosed system 10 can be used to create larger, more complex, burner arrangement. Also, these figures illustrate that elbow sections can also be used to connect additional of jet support sections 40 to better cover larger areas.

Figure 11:
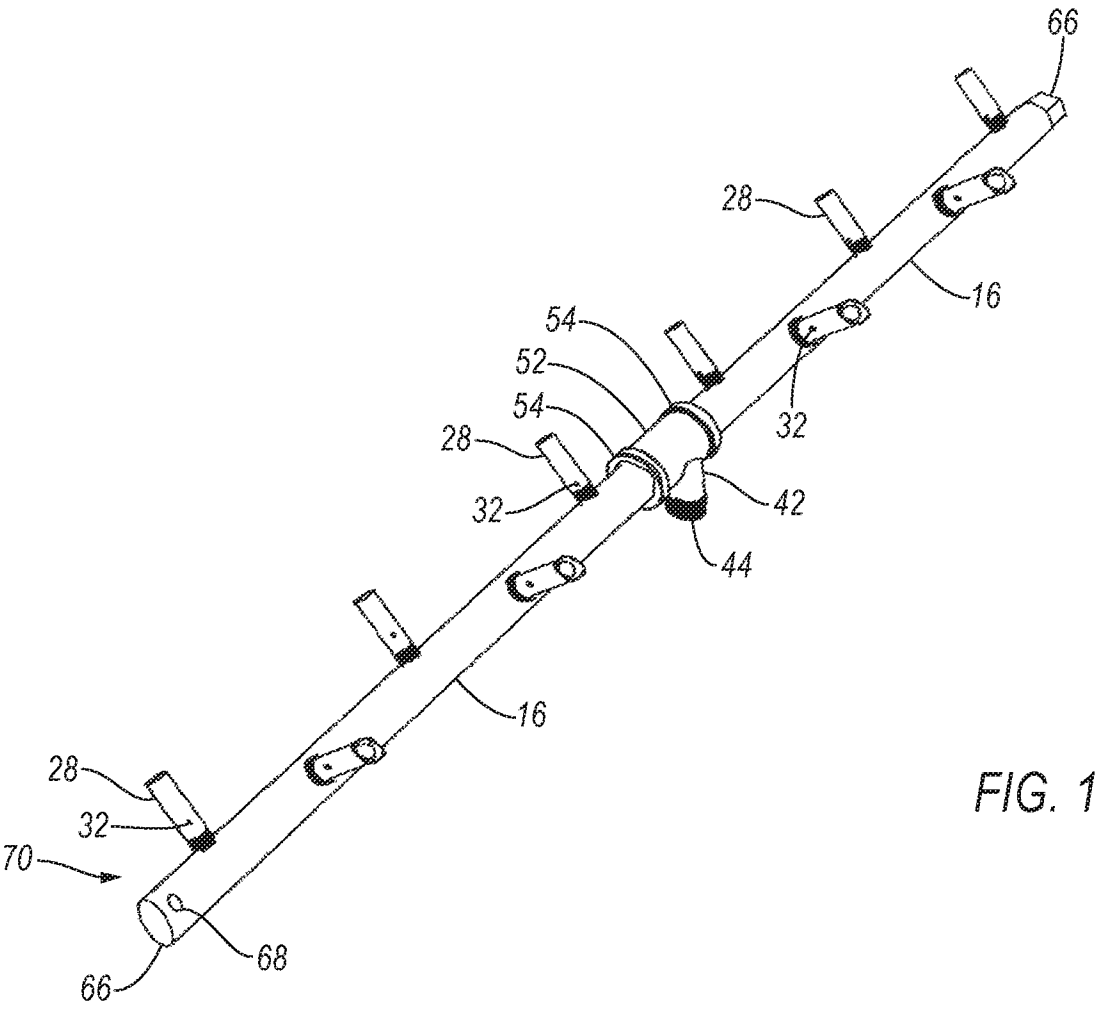
FIG. 11 shows an example of an arrangement that creates a single line of flames, the figure also showing examples of features that may be incorporated to facilitate turning the nipples during installation or assembly.

Turning now to FIG. 11, which shows an arrangement that creates a single line of flames, it will be understood a nipple 16 with a blind end 66 may include an aperture 68 across the end 70 of the nipple 16. It is also contemplated that instead of an aperture 68, the end 70 may instead, or also, include a slot of a desired shape that cooperates with a turning socket 72, illustrated in FIG. 12.

Turning now to FIG. 12, which shows the turning socket 72 will cooperate with a wrench handle 74 to turn the nipple 16 in order to tighten or loosen the nipple 16. The blind end 66 of the nipple 12 is referred to as being "blind," meaning that the bore 24 does not extend through the entire length of the nipple 16. The turning socket 72 includes an internal bore 78, and also includes an aperture 74 that extends through the side 76 of the turning socket 72 and into the internal bore 78. The aperture 74 is positioned such that a pin 80 may be inserted through the aperture 74 in the side 76, and thus allowing the pin 80 to engage the aperture 68 when the blind end 66 has been accepted within the internal bore 78.

FIG. 13 is a sectional view along the length of the turning socket 72, and illustrates that the internal bore 78 of the turning socket 72 may incorporate stepped internal portions 82 that better accommodate different diameters of nipples 16.

As discussed above, instead of using the aperture 68 at the blind end 66, a slot that cooperates with the pin 80 may be used. Alternatively, the turning socket 72 may include protrusions that extend into the internal bore 78 and cooperate with the slot or other mating surface incorporated in the blind end 66. Also, it is contemplated that handle 74 with a pin 80 that extends into the aperture 68 may also be used to turn the nipple 16. However, the use of a socket such as the turning socket 72 offers the advantage that the turning socket 72 may be attached to a torque wrench, allowing the torque wrench to be used to ensure proper tightening of the nipple 16.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

The invention claimed is:

1. A burner system comprising:

a connector;

at least two burners directly connected to the connector;

each of the at least two burners including a nipple that is brass and a jet that is brass;

in each of the at least two burners:

the nipple has a first end that is threaded and a second end that is closed, the first end threadedly engaged directly with the connector;

the nipple has a side wall between the first end and the second end, the side wall defining a bore, the bore extends through the first end to the second end;

the first end, second end, and side wall of the nipple are of integral, one piece, construction free of joints;

the nipple has a threaded hole extending through the side wall of the nipple to the bore; and the jet has a threaded end threadedly engaged with the threaded hole.

2. The burner system as set forth in claim 1, wherein the connector has a gas inlet, a first gas outlet, and a second gas outlet, a first one of the at least two burners being directly connected to the first gas outlet and a second one of the at least two burners being directly connected to the second gas outlet.

3. The burner system as set forth in claim 2, wherein the connector has a third gas outlet and a third one of the at least two of the burners is directly connected to the third gas outlet.

4. The burner system as set forth in claim 3, wherein the first one, second one, and third one of the burners extend radially from the connector.

5. The burner system as set forth in claim 3, wherein the first gas outlet, the second gas outlet, and the third gas outlet are threaded;

the threaded end of the nipple of the first one of the burners being threadedly engaged directly with the first gas outlet;

the threaded end of the nipple of the second one of the burners being threadedly engaged directly with the second gas outlet; and the threaded end of the nipple of the third one of the burners being threadedly engaged directly with the first gas outlet.

6. The burner system as set forth in claim 2, wherein the gas inlet is vertical and the first gas outlet and the second gas outlet are horizontal.

7. The burner system as set forth in claim 1, wherein, in the at least two of the burners, the nipple has a threaded end threadedly engaged directly with threaded gas outlets in the connector.

8. The burner system as set forth in claim 1, wherein one of the at least two of the burners includes more than one of the jets.

9. The burner system as set forth in claim 1, wherein the hole in the nipple is threaded and the first end of the jet is threaded and threadedly engaged with the hole.

10. A burner system comprising:

a connector;

a plurality of burners directly connected to the connector, the plurality of burners including a first burner, a second burner, and a third burner;

each of the plurality of burners including a nipple that is brass and a jet that is brass;

in each of the plurality of burners:

the nipple has a first end that is threaded and a second end that is closed, the first end threadedly engaged directly with the connector;

the nipple has a side wall between the first end and the second end, the side wall defining a bore, the bore extends through the first end to the second end;

the first end, second end, and side wall of the nipple are of integral, one piece, construction free of joints;

the nipple has a threaded hole extending through the side wall of the nipple to the bore; and the jet has a threaded end threadedly engaged with the threaded hole.

11. The burner system as set forth in claim 10, wherein the connector has a gas inlet a plurality of gas outlets, the gas outlets being threaded and the first end of the nipple of each burner being threadedly engaged directly with one of the gas outlets.

12. The burner system as set forth in claim 11, wherein the plurality of burners are spaced from each other and extend radially from the connector.

13. The burner system as set forth in claim 12, wherein the nipples are cantilevered from the connector.

14. The burner system as set forth in claim 10, wherein the plurality of burners are spaced from each other and extend radially from the connector.

15. The burner system as set forth in claim 10, wherein the nipples are cantilevered from the connector.

16. The burner as set forth in claim 10, wherein the nipples are elongated from the connector.

17. The burner as set forth in claim 10, wherein the nipples are supported entirely by the connector.

18. The burner as set forth in claim 10, wherein the connector is central to the nipples.

* * * * *